US009431724B2

(12) United States Patent
France et al.

(10) Patent No.: US 9,431,724 B2
(45) Date of Patent: Aug. 30, 2016

(54) DETACHABLE CONNECTOR

(71) Applicant: ABB TECHNOLOGY AG, Zurich (CH)

(72) Inventors: Philippe France, Chazelles sur Lyon (FR); Romain Villard, Saint-Priest (FR)

(73) Assignee: ABB TECHNOLOGY AG, Zurich (CH)

( * ) Notice: Subject to any disclaimer, the term of this patent is extended or adjusted under 35 U.S.C. 154(b) by 0 days.

(21) Appl. No.: 14/699,037

(22) Filed: Apr. 29, 2015

(65) Prior Publication Data

US 2015/0311604 A1 Oct. 29, 2015

(30) Foreign Application Priority Data

Apr. 29, 2014 (FR) ..... 14 53883

(51) Int. Cl.

| | |
|---|---|
| ***H01R 4/26*** | (2006.01) |
| ***H01R 4/48*** | (2006.01) |
| ***H01R 24/20*** | (2011.01) |
| *H01R 13/11* | (2006.01) |

(52) U.S. Cl.

CPC ..... *H01R 4/4818* (2013.01); *H01R 4/4827* (2013.01); *H01R 24/20* (2013.01); *H01R 13/11* (2013.01)

(58) Field of Classification Search

CPC .. H01R 4/4818; H01R 4/4827; H01R 13/11; H01R 24/20

USPC ..... 439/435–441, 836–839

See application file for complete search history.

(56) References Cited

U.S. PATENT DOCUMENTS

| | | | | |
|---|---|---|---|---|
| 6,280,233 | B1 | 8/2001 | Beege et al. | |
| 6,336,824 | B1 | 1/2002 | Sorig | |
| 2005/0042912 | A1* | 2/2005 | Drewes | H01R 31/08 439/441 |
| 2007/0049104 | A1 | 3/2007 | Reibke | |
| 2008/0089049 | A1 | 4/2008 | Besana et al. | |

* cited by examiner

*Primary Examiner* — Khiem Nguyen

(74) *Attorney, Agent, or Firm* — Cantor Colburn LLP

(57) ABSTRACT

The present invention relates to a detachable connector (1) for a junction block comprising:

an insulating body (2), a connection terminal (10) having a housing (8) for an electrically conductive wire (C) intended to be inserted through a first opening (3) of the insulating body (2) along an insertion direction (D) of the electrically conductive wire (C) in the insulating body (2), a connection plug (20) comprising a socket (21) from which extend two elastic connection branches (22*a*, 22*b*) intended to ensure an electrical contact with a complementary plug of the junction block intended to pass through a second opening (4) of the insulating body (2), the detachable connector (1) being characterized in that it comprises a passageway (6) for the electrically conductive wire (C) connecting the first housing (8) of the connection terminal (10) and a second housing (9) formed in the socket (21) of the connection plug (20).

12 Claims, 2 Drawing Sheets

DETACHABLE CONNECTOR

CROSS REFERENCE TO RELATED APPLICATION

This application is related to and claims the benefit of French Patent Application Number 14/53883 filed on 29 Apr. 2014, the entire contents of which are herein incorporated by reference.

TECHNICAL FIELD

The present invention concerns the field of connecting low-voltage electrical appliances and more particularly, it relates to a detachable connector for junction blocks.

BACKGROUND

A detachable connector for a junction block ensures the electrical connection between an electrically conductive wire and a plug of the junction block connected to a first connection portion.

Thus, a detachable connector may be replaced on a junction block depending on the characteristics of the electrical conductor to be connected, and in particular on its diameter.

Thus, it is known to provide a detachable connector for a junction block comprising:

an insulating body, a connection terminal having a housing for an electrically conductive wire intended to be inserted through a first opening of the insulating body along an insertion direction of the electrically conductive wire in the insulating body, and a connection plug comprising a socket from which extend two elastic connection branches intended to ensure electrical contact with a complementary plug of the junction block intended to pass through a second opening of the insulating body.

However, the connection terminal and the connection plug are arranged in the insulating body of the detachable connector in an independent manner.

Indeed, the connection terminal has only the function of creating an electrical link with the electrically conductive wire.

The connection plug has in turn only the function of creating an electrical link with the complementary plug of the junction block.

The connection plug has no mechanical interaction with the electrically conductive wire which remains distant from the latter.

Furthermore, the connection terminal exerts a clamping pressure on a portion of the electrically conductive wire located apart from its free end.

Consequently, the insulating body comprises a specific housing for receiving this end of the electrically conductive wire which has passed through the connection terminal.

The presence of this specific housing in the insulating body induces a minimal sizing of the dimensions of the detachable connector, and in particular of its height.

Typically, a detachable connector of the state of the art has an overall dimension of at least 40 mm.

In some cases, the size of the detachable connectors prevents the insertion of an additional row of connection blocks in an electrical cabinet or box.

BRIEF SUMMARY

The present invention aims to solve all or part of the aforementioned drawbacks.

To this end, the present invention relates to a detachable connector such as previously described characterized in that it comprises a passageway for the electrically conductive wire connecting the first housing of the connection terminal and a second housing formed in the socket of the connection plug.

This arrangement allows reducing the size of the detachable connector by assigning to the socket of the connection plug the dual function of holding the elastic connection branches and of housing the electrically conductive wire.

According to one aspect of the invention, the passageway is realized in the insulating body.

Thus, for example, the absence of portions of the insulating body between the first housing of the connection terminal and the second housing formed in the socket of the connection plug may allow forming a passageway for the electrically conductive wire.

According to one aspect of the invention, the second housing is disposed in alignment with the first housing along the insertion direction of the electrically conductive wire.

This arrangement allows facilitating access of the electrically conductive wire to the second housing.

According to one aspect of the invention, the socket of the connection plug has a U-shaped profile.

This arrangement allows creating easily the socket of the connection plug by extending the two elastic connection branches from the two branches of the U-shape.

According to one aspect of the invention, the connection terminal is of the leaf spring type.

This arrangement allows facilitating the insertion of the electrically conductive wire into the connection terminal.

According to one aspect of the invention, the leaf spring type connection terminal comprises a conductive part, said conductive part and the connection plug being formed in one-piece.

This arrangement allows facilitating the assembly of the detachable connector while optimizing the manufacturing costs.

According to one aspect of the invention, the conductive part comprises a first portion having an opening disposed facing the first opening of the insulating body.

The presence of an opening allows disposing the first portion transversally to the extension direction of the electrically conductive wire while letting the latter pass. Thus, it is not necessary to provide a first portion that bypasses the electrically conductive wire. Hence, this arrangement allows realizing a compact conductive part and thereby achieving a space and material saving.

According to one aspect of the invention, the conductive part comprises a second portion and a bend connecting the first portion to the second portion.

According to one aspect of the invention, the second portion is solid and extends in a plane substantially parallel to the insertion direction of the electrically conductive wire.

According to one aspect of the invention, the first portion extends substantially in a plane tilted with respect to a plane transverse to the insertion direction of the electrically conductive wire.

According to one aspect of the invention, the leaf spring type connection terminal comprises a leaf spring including a bearing branch and a clamping branch connected together by a bend.

This arrangement allows for an additional space saving in the insulating body of the detachable connector.

According to one aspect of the invention, the bearing branch bears on a first edge of the opening of the first portion and wherein the clamping branch is intended to clamp the electrically conductive wire against a second edge of the opening of the first portion opposite to the first edge and against the second portion of the connection terminal.

The opening is not only intended for the passage of the electrically conductive wire but it is also intended to serve as support to the leaf spring. Hence, this arrangement allows for a space and material saving by realizing a compact arrangement of the connection terminal.

According to one aspect of the invention, the insulating body comprises a portion disposed between the two elastic connection branches and adjacent to the second housing.

This arrangement allows creating an abutment so as to prevent the electrically conductive wire from interfering during the insertion of the connection plug of the detachable connector in the complementary connection plug of the junction block.

According to one aspect of the invention, the detachable connector has an overall dimension of less than 35 mm.

BRIEF DESCRIPTION OF THE DRAWINGS

Anyway, the invention will be better understood upon reading the description that follows, with reference to the appended schematic drawing representing, as a non-limiting example, a detachable connector according to the invention.

DETAILED DESCRIPTION

Figure 1:
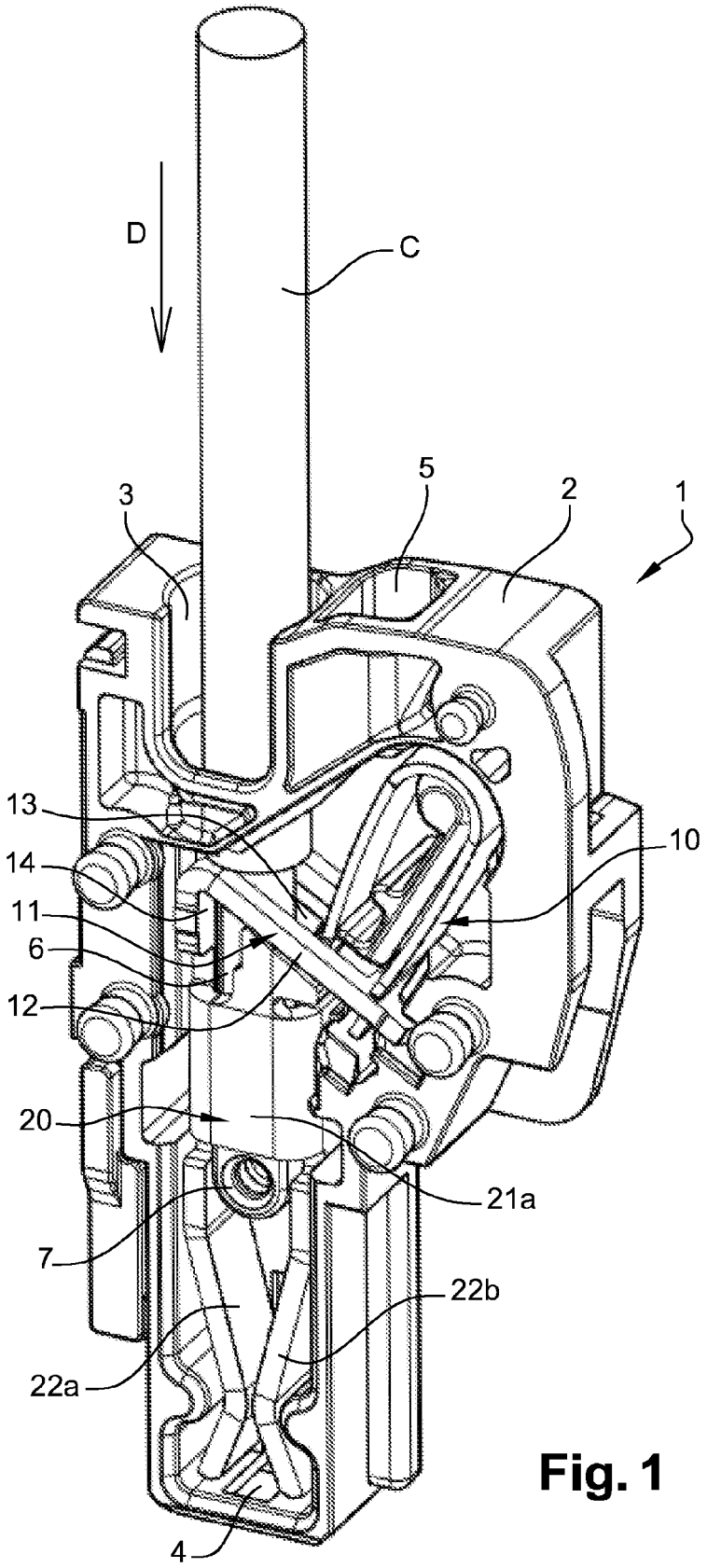
FIG. 1 is an overview of a detachable connector according to the invention in position with an electrically conductive wire.

As is illustrated in FIG. 1, a detachable connector 1 according to the invention comprises an insulating body 2, a connection terminal 10 and a connection plug 20.

The insulating body 2 comprises a first opening 3 intended to enable the insertion of an electrically conductive wire C, a second opening 4 intended to enable the insertion of a male plug of a junction block (not illustrated).

Furthermore, the insulating body 2 comprises a third opening 5 intended for the insertion of a tool (not illustrated).

In the presented example, the connection terminal 10 is of the spring-type and comprises a conductive part 11 disposed in the insulating body 2 and a leaf spring 16.

The conductive part 11 is fixed in the insulating body 2.

The conductive part 11 comprises a first portion 12 and a second portion 14 connected together by a bend 15.

The first portion 12 has an opening 13 disposed facing the first opening 3 of the insulating body 2.

Furthermore, the first portion 12 extends substantially in a plane tilted with respect to a plane transverse to the insertion direction D of the electrically conductive wire C.

The second portion 14 is solid and extends substantially in a plane substantially parallel to the insertion direction D of the electrically conductive wire C.

The first portion 12 and the second portion 14 are made of an electrically conductive material.

Furthermore, the leaf spring 16 of the connection terminal 10 comprises a first bearing branch 17 bearing on a first edge of the opening 13 of the first portion 12 and a movable clamping branch 18 intended to clamp the electrically conductive wire C against a second edge of the opening 13 of the first portion 12 opposite to the first edge and against the second portion 14 of the connection terminal 10.

The bearing branch 17 and the clamping branch 18 are connected together by a bend 19.

The removal of the electrically conductive wire C from the insulating body 2 may be achieved by applying a stress on the clamping branch 18 of the leaf spring 16 using a tool inserted through the third opening 5.

Thus, the connection terminal 10 forms a housing 8 for the electrically conductive wire C introduced in the insulating body 2 through the first opening 3.

In the proposed example, this housing 8 may be defined as being an area of the space located substantially between the two planes in which extend substantially the first portion 12 and the second portion 14 of the conductive part 11 of the connection terminal 10 and a plane substantially transverse to the insertion direction D of the electrically conductive wire C in the insulating body 2 in which fits the free end of the first portion 12 of the conductive part 11 of the connection terminal 10.

The connection plug 20 comprises in turn a socket 21 having a U-shaped profile having a base 21*a* and two branches 21*b*, 21*c*.

The branches 21*b*, 21*c* of the U-shape of the socket 21 extend substantially along a direction transverse to the insertion direction D of the electrically conductive wire C in the insulating body 2 and along two planes substantially parallel to the plane in which extends the second portion 14 of the conductive part 11 of the connection terminal 10.

Furthermore, in the presented example, the second portion 14 of the conductive part 11 of the connection terminal 10 is directly connected to a lateral edge of one of the branches 21*b* of the U-shaped socket 21 facing the connection terminal 10.

In addition, this branch 21*b* of the socket 21 and the second portion 14 of the conductive part 11 of the connection terminal 10 extend in a same plane.

Finally, the connection plug 20 comprises two elastic connection branches 22*a*, 22*b* each extending from one of the two edges of the branches 21*b*, 21*c* of the U-shaped socket 21 opposite to the two edges facing the connection terminal 10.

These two elastic connection branches 22*a*, 22*b* form a female plug and are intended to ensure an electrical contact with a male plug of the junction block (not illustrated) intended to be inserted between the two elastic connection branches 22*a*, 22*b* through the second opening 4 of the insulating body 2.

Figure 2:
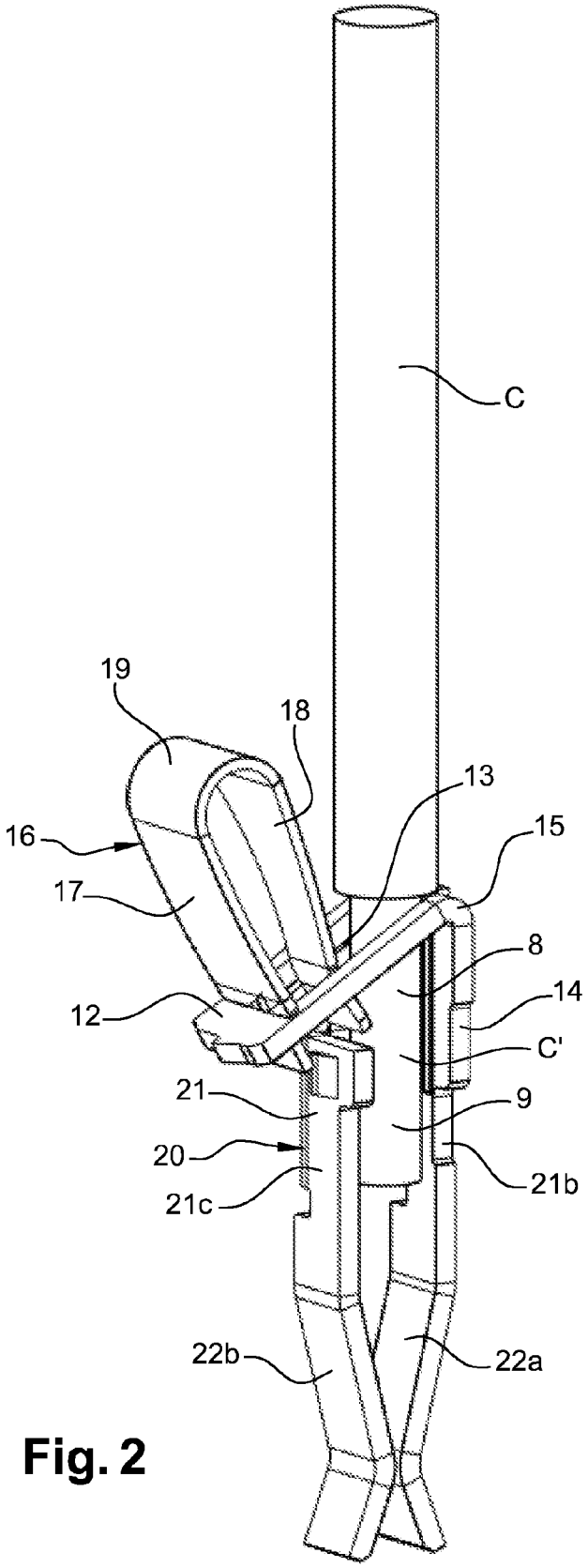
FIG. 2 is a view of a detachable connector according to the invention in position with an electrically conductive wire but to which the insulating body has been removed.

In the presented example, and as is shown in FIG. 2, the connection plug 20 comprising the socket 21 and the two elastic connection branches 21*a*, 21*b* are formed in one-piece with the conductive part 11 of the connection terminal 10 comprising the first portion 12 and the second portion 14.

The socket 21 of the connection plug 20 forms a second housing 9 in addition to the first housing 8 for the electrically conductive wire C introduced in the insulating body 2 through the first opening 3.

In the presented example, this second housing 9 may be defined as being an area of the space located substantially between the two branches 21*b*, 21*c* of the U-shaped socket 21 of the connection plug 20.

Similarly, in the presented example, the second housing 9 is disposed in alignment with the first housing 8 for the electrically conductive wire C of the connection terminal 10 along the insertion direction D of the electrically conductive wire C.

Furthermore, the detachable connector 1 comprises a passageway 6 between the first housing 8 and the second housing 9 in order to allow the end C' of the electrically conductive wire C to reach the second housing 9 after having passed through the first housing 8.

This passageway 6 results from the absence of portions of the connection terminal 10 and/or of the connection plug 20 and/or of the insulating body 2 between the first housing 8 and the second housing 9.

Finally, the insulating body 2 comprises a portion 7 disposed between the two elastic connection branches 22*a*, 22*b* and adjacent to the second housing 9 so as to prevent the end C' of the electrically conductive wire C from reaching the connection plug 20.

The detachable connector 1 has an overall dimension or a height of less than 35 mm compared to a size of at least 40 mm for a detachable connector of the state of the art.

This space saving, due to the presence of the second housing 9, allows reducing the spacing between the support rails of the junction blocks and consequently allows increasing the number of blocks that may equip an electrical cabinet or box.

Although the invention has been described in connection with particular embodiments, it goes without saying that it is not limited thereto and that it encompasses all technical equivalents of the described means as well as their combinations.

Thus, in a non illustrated embodiment, the second housing 9 is not disposed directly in alignment with the first housing 8 along the insertion direction D of the electrically conductive wire C but is slightly offset from the latter.

In such an embodiment, the electrically conductive wire C passes through the first housing 8 then it is guided toward the second housing 9 through the passageway 6 by sliding along the second portion 14 of the conductive part 11 of the connection terminal 10.

The invention claimed is:

1. A detachable connector for a junction block comprising:

an insulating body, a connection terminal having a first housing for an electrically conductive wire intended to be inserted through a first opening of the insulating body along an insertion direction of the electrically conductive wire in the insulating body, a connection plug comprising a socket from which extend two elastic connection branches intended to ensure an electrical contact with a complementary plug of the junction block intended to pass through a second opening of the insulating body, the detachable connector comprising a passageway for the electrically conductive wire connecting a first housing of the connection terminal and a second housing formed in the socket of the connection plug.

2. The detachable connector according to claim 1, wherein the second housing is disposed in alignment with the first housing along the insertion direction of the electrically conductive wire.

3. The detachable connector according to claim 1, wherein the socket of the connection plug has a U-shaped profile.

4. The detachable connector according to claim 1, wherein the connection terminal is of the leaf spring type.

5. The detachable connector according to claim 4, wherein the leaf spring type connection terminal comprises a conductive part, said conductive part and the connection plug being formed in one-piece.

6. The detachable connector according to claim 5, wherein the conductive part comprises a first portion having an opening disposed facing the first opening of the insulating body.

7. The detachable connector according to claim 6, wherein the conductive part comprises a second portion and a bend connecting the first portion to the second portion.

8. The detachable connector according to claim 7, wherein the second portion is solid and extends in a plane substantially parallel to the insertion direction of the electrically conductive wire.

9. The detachable connector according to claim 6, wherein the first portion extends substantially in a plane tilted with respect to a plane transverse to the insertion direction of the electrically conductive wire.

10. The detachable connector according to claim 4, wherein the leaf spring type connection terminal comprises a leaf spring including a bearing branch and a clamping branch connected together by a bend.

11. The detachable connector according to claim 7, wherein the bearing branch bears on a first edge of the opening of the first portion and wherein the clamping branch is intended to clamp the electrically conductive wire against a second edge of the opening of the first portion opposite to the first edge and against the second portion of the connection terminal.

12. The detachable connector according to claim 1, wherein the insulating body comprises a portion disposed between the two elastic connection branches and adjacent to the second housing.

* * * * *